US006603399B1

(12) United States Patent
Rührig

(10) Patent No.: US 6,603,399 B1
(45) Date of Patent: Aug. 5, 2003

(54) STRIP FOR PREPARING SAFETY ELEMENTS FOR ELECTRONIC PROTECTION OF GOODS

(75) Inventor: Manfred Rührig, Weinheim (DE)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/380,628

(22) PCT Filed: Mar. 11, 1998

(86) PCT No.: PCT/EP98/01390

§ 371 (c)(1),
(2), (4) Date: Sep. 20, 1999

(87) PCT Pub. No.: WO98/43219

PCT Pub. Date: Oct. 1, 1998

(30) Foreign Application Priority Data

Mar. 20, 1997 (DE) ..... 197 11 626

(51) Int. Cl.[7] ..... G08B 13/14

(52) U.S. Cl. ..... 340/572.1; 340/572.3; 340/572.8

(58) Field of Search ..... 340/572.1, 572.2, 340/572.3, 572.5, 572.6, 572.8, 572.9

(56) References Cited

U.S. PATENT DOCUMENTS 4,710,754 A * 12/1987 Montean ..... 340/572.6
5,392,028 A 2/1995 Pichl ..... 340/572.5
5,432,499 A * 7/1995 Montean ..... 340/572.6
5,714,935 A * 2/1998 Ryan, Jr. ..... 340/572.3
5,867,102 A * 2/1999 Souder et al. ..... 340/572.8
5,921,583 A * 7/1999 Matsumoto et al. ..... 340/572.6

FOREIGN PATENT DOCUMENTS

| | | |
|---|---|---|
| DE | 4323883 A1 | 1/1995 |
| DE | 4416444 A1 | 11/1995 |
| EP | 0635811 A1 | 1/1995 |
| EP | 0682333 A1 | 11/1995 |
| EP | 0724246 A2 | 7/1996 |

* cited by examiner

*Primary Examiner*—Benjamin C. Lee
*Assistant Examiner*—Sihong Huang
(74) *Attorney, Agent, or Firm*—Jones, Tullar & Cooper, P.C.

(57) ABSTRACT

The present invention relates to a strip for preparing security elements for electronic protection of goods including a carrier strip with adhesive labels detachably stuck on, or of interconnected tags to be fixed to goods which are to be labeled or protected. Only a certain number of labels or tags have electromagnetically active or activatable security elements. The strip demonstrates a substantially equal level of detection in different surveillance systems. To this end, the security elements consist of at least two types of security elements which are detectable in different surveillance systems.

9 Claims, 1 Drawing Sheet

STRIP FOR PREPARING SAFETY ELEMENTS FOR ELECTRONIC PROTECTION OF GOODS

FIELD OF THE INVENTION

The present invention relates to a strip for making available security elements for electronically securing objects. The strip consists of a carrier web with adhesive labels removably glued thereon, or of tags which are connected with each other for fastening on objects to be priced or secured, wherein only a defined number of labels or tags is equipped with electromagnetically active, or respectively activatable, security elements.

BACKGROUND OF THE INVENTION

A strip of security labels and a device for producing such a strip are known from European patent, EP 0 682 333 A1. To keep production costs low, only a defined number of labels, or respectively tags, of the strip of security labels is equipped with activatable or electromagnetically active security elements, while the remaining labels, or respectively tags, do not contain security elements, or contain dummy security elements. It has been shown to be advantageous to provide a coating impervious to light, which makes it impossible to determine whether or not the label, or respectively the tag, has a security element, without destroying the label or the tag. Labels with hidden security elements are already known from European patent, EP 0 635 811 A1.

SUMMARY OF THE INVENTION

The object of the present invention is to provide a cost-efficient strip, which has an essentially equal detection rate in various monitoring systems.

This object is attained in that the security elements are constituted of at least two types of security elements, which can be detected in different monitoring systems.

In accordance with an advantageous further development of the strip of the present invention it is provided that the security elements are strip elements of low magnetic retentivity, which can be detected in harmonic monitoring systems, and strip elements with a high Barkhausen effect, which can be detected in Barkhausen monitoring systems.

An alternative embodiment proposes, that the security elements are acousto-magnetic security elements or resonant circuit security elements. It is of course also possible to integrate the most diverse types of security elements into a strip in accordance with the present invention and in this way to make it universally usable for the most diverse types of monitoring systems. Nevertheless, it is a preferred embodiment of the strip in accordance with the present invention, wherein two types of security elements are contained in the strip to essentially equal proportions.

An advantageous embodiment of the strip in accordance with the present invention proposes to integrate the security elements into the labels, or respectively tags, in such a way, that it is not possible from the outside to determine whether or what types of security elements are used in the labels.

The theft-protective label consists in particular of a carrier foil for an electromagnetic security element and of a pricing element which is glued on the security element. On its side facing the security element, the pricing element is provided with a layer which has such a low transparency for light waves in the visible range that the securing element cannot be detected from the outside.

In accordance with an advantageous further embodiment of the strip of the present invention it is provided that, for securing the source, the labels or tags can be integrated into the objects to be secured. In this case steps which make the security element invisible to the exterior, can usually be omitted.

In many cases it is desirable for the security element to be deactivated as soon as the customer has correctly paid for the respective secured goods. Therefore an embodiment of the strips in accordance with the present invention provides for the securing elements to be deactivatable. In the case of security elements of low magnetic retentivity or security elements with a great Barkhausen effect, sections of a semi-magnetic or highly magnetic material are arranged for deactivation purposes on the label or tags in such a way, that they prevent a reaction of the low-retentive magnetic material or the Barkhausen material to an exterior alternating magnetic field as soon as they have been pushed to saturation by means of a suitable high deactivation signal.

In the case of resonant circuits, deactivation can be achieved, for example, in that a permanent short circuit penetrating the dielectric layer is generated between two opposite strip conductors.

Alternatively to the solution that some of the labels or tags do not contain any security elements at all it is provided that the labels or tags not provided with security elements are equipped with dummy security elements. This embodiment is already known from the previously mentioned European patent, EP 0 682 333 A1.

BRIEF DESCRIPTION OF THE DRAWINGS

The present invention will be explained in greater detail in what follows by means of the following drawing figures.

DESCRIPTION OF THE PREFERRED EMBODIMENTS

Figure 1:
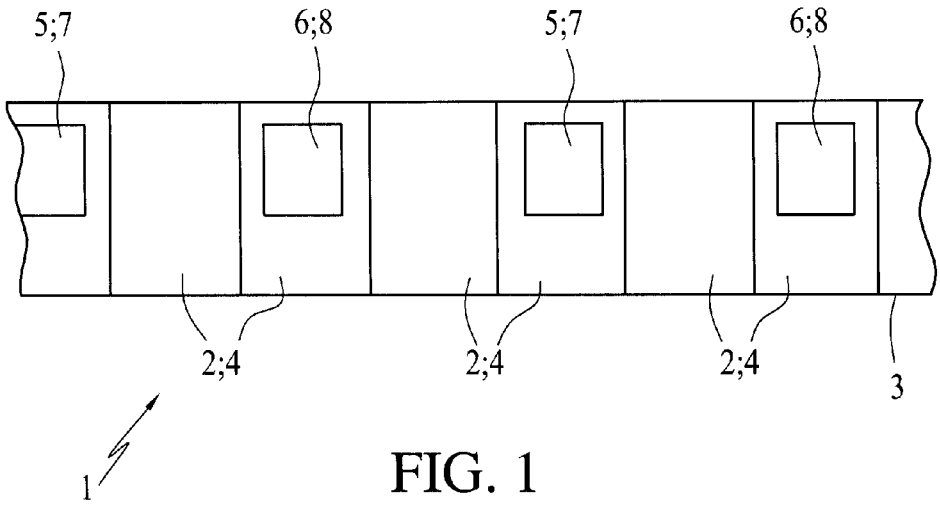
FIG. 1, is a view from above of a first embodiment of the strip in accordance with the present invention.

FIG. 1 shows a strip 1 with labels 2, which have been removably glued to a carrier web 3, which are arranged on the latter. However, the strip 1 can also be in the form of tags 4, which are connected with each other on their transverse sides. Every second one of these labels 2, or respectively every second one of these tags 4, has a security element. In the illustrated case, a low-retentive magnetic element 6 respectively alternates with a Barkhausen security element 5. In this way the objects, which are secured by means of labels 2, or respectively tags 4, of the present invention, have the same detection rate in harmonic monitoring systems and in Barkhausen monitoring systems.

As already previously described, all known security elements 5, 6, 7, 8 can appear in any desired combination on a strip in accordance with the present invention. Of course the ratio of the labels 2, or respectively tags 4, carrying a security element 5, 6, 7, 8 is not limited to the ratio 1:2 represented. Any arbitrary ratio can be realized and should be counted in the disclosure contents of the present invention. It is of course also possible to arrange the different security elements 5, 6, 7, 8 in or on the strip 1 of the invention in accordance with a random principle.

Figure 2:
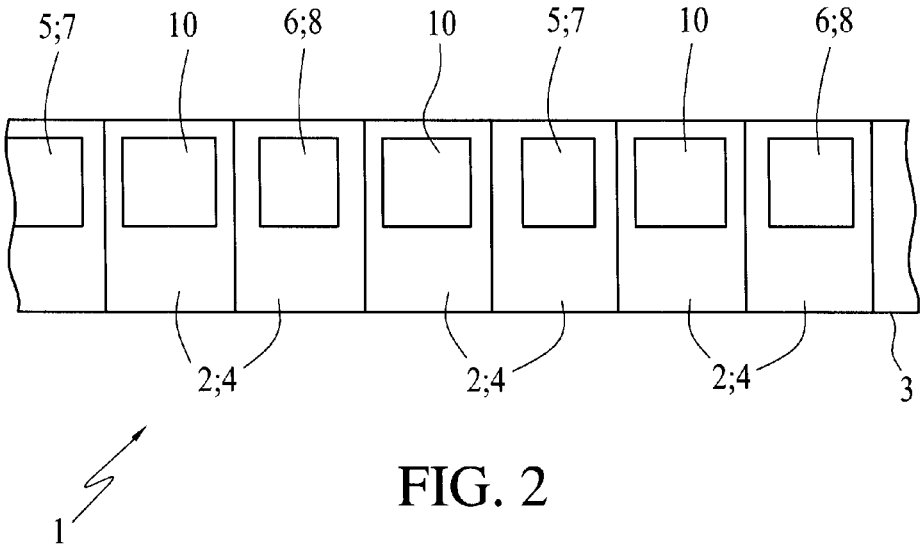
FIG. 2, is a view from above of a second embodiment of the strip in accordance with the present invention.

A view from above on a second embodiment of the strip 1 of the present invention is represented in FIG. 2. To make it impossible for a thief to detect from the outside whether or not an object is protected by means of a security element 5, 6, 7, 8, every second (or every third, fourth, etc.) label 2, or respectively every second (or every third, fourth, etc.) tag 4, has a dummy security element 10. An alternate solution consists—as already mentioned—in designing the label 2, or respectively the tag 4, in such a way that, viewed from the exterior, the security element 5, 6, 7, 8 remains invisible.

What is claimed is:

1. A strip for making security elements for electronically securing objects comprising:

a carrier web; and a plurality of adhesive labels or tags connected with each other removable glued thereon, for fastening on objects, wherein:

said plurality of adhesive labels or tags include only a defined number of labels or tags each being equipped with a single electromagnetically active or activatable security element; and said plurality of adhesive labels or tags comprise at least two types of security elements which can be detected in different monitoring systems.

2. The strip as defined in claim 1, wherein:

said plurality of adhesive labels or tags comprise low-retentive magnetic strip elements which can be detected in harmonic monitoring systems, and strip elements with a high Barkhausen effect which can be detected in Barkhausen monitoring systems.

3. The strip as defined in claim 1, wherein:

said plurality of adhesive labels or tags comprise one of acousto-magnetic security elements and resonant circuit security elements.

4. The strip as defined in claim 1, wherein:

said plurality of adhesive labels or tags comprise equal numbers of at least two types of security elements.

5. The strip as defined in claim 1, wherein:

said plurality of adhesive labels or tags comprise security elements which are integrated into said labels or tags such that they are not distinguished from the exterior.

6. The strip as defined in claim 1, further comprising:

a coating, impermeable to light over said plurality of adhesive labels or tags, wherein:

said plurality of adhesive labels or tags comprise security elements which are integrated into said labels or tags such that they are not distinguished from the exterior without destroying said labels or tags.

7. The strip as defined in claim 1, wherein:

said plurality of adhesive labels or tags are integrated into the objects to be secured.

8. The strip as defined in claim 1, wherein:

said plurality of adhesive labels or tags are deactivatable.

9. The strip as defined in claim 1, wherein:

said plurality of adhesive labels or tags include adhesive labels or tags equipped with dummy security elements.

* * * * *